US006822532B2

(12) United States Patent
Kane et al.

(10) Patent No.: US 6,822,532 B2
(45) Date of Patent: Nov. 23, 2004

(54) SUSPENDED-STRIPLINE HYBRID COUPLER

(75) Inventors: John R. Kane, Natick, MA (US); Richard J. Garabedian, Bedford, NH (US)

(73) Assignee: Sage Laboratories, Inc., Natick, MA (US)

( * ) Notice: Subject to any disclaimer, the term of this patent is extended or adjusted under 35 U.S.C. 154(b) by 0 days.

(21) Appl. No.: 10/207,670

(22) Filed: Jul. 29, 2002

(65) Prior Publication Data

US 2004/0017267 A1 Jan. 29, 2004

(51) Int. Cl.[7] ..... H01P 3/08; H01P 5/12

(52) U.S. Cl. ..... 333/116; 333/115; 333/238; 333/244; 333/246

(58) Field of Search ..... 333/115–116, 238, 333/244, 246

(56) References Cited

U.S. PATENT DOCUMENTS

| | | | | |
|---|---|---|---|---|
| 3,358,248 A | | 12/1967 | Saad | |
| 3,508,170 A | * | 4/1970 | Poulter | 333/115 |
| 3,904,997 A | * | 9/1975 | Stinehelfer, Sr. | 333/116 |
| 4,027,254 A | * | 5/1977 | Gunton et al. | 333/109 |
| 4,178,568 A | * | 12/1979 | Gunton | 333/116 |
| 4,375,054 A | * | 2/1983 | Pavio | 333/116 |
| 4,394,630 A | * | 7/1983 | Kenyon et al. | 333/116 |
| 4,521,747 A | | 6/1985 | Tahim et al. | |
| 4,521,755 A | * | 6/1985 | Carlson et al. | 333/244 |
| 4,547,753 A | | 10/1985 | Chapell | |
| 4,641,111 A | | 2/1987 | Chapell | |
| 5,012,209 A | | 4/1991 | Lantagne et al. | |
| 5,047,737 A | | 9/1991 | Oldfield | |
| 5,075,646 A | | 12/1991 | Morse | |
| 5,111,165 A | * | 5/1992 | Oldfield | 333/116 |
| 5,148,132 A | | 9/1992 | Chapell | |
| 5,225,799 A | | 7/1993 | West et al. | |
| 5,243,305 A | * | 9/1993 | D'Oro et al. | 333/116 |
| 6,437,661 B2 | * | 8/2002 | Nishimura et al. | 333/116 |
| 6,603,376 B1 | * | 8/2003 | Handforth et al. | 333/238 |

FOREIGN PATENT DOCUMENTS

EP 1139487 A1 4/2001

OTHER PUBLICATIONS

Fan et al., "Broadside Coupled Strip Inset Dielectric Guide and its Directional Coupler Application", IEEE Transactions on Microwave Theory and Techniques, vol. 43, No. 3, pp. 612–619, Mar., 1995.

Michael Dydyk, "Accurate Design of Microstrip Directional Coupler With Capacitive Compensation", IEEE, MTT–S Digest, pp. 581–584, 1990.

(List continued on next page.)

*Primary Examiner*—Michael Tokar
*Assistant Examiner*—Khai Nguyen
(74) *Attorney, Agent, or Firm*—Wolf, Greenfield & Sacks, P.C.; James H. Morris

(57) ABSTRACT

A suspended stripline device and method for manufacturing thereof. The device includes first and second conductive traces disposed on a dielectric substrate, each of the first and second conductive traces having a first edge and a second edge, and a housing at least partially surrounding the dielectric substrate, wherein the second edge of each of the first and second conductive traces includes at least one outwardly extending protrusion, the size and orientation of which may be selected so as to compensate for unequal even and odd mode propagation velocities through the suspended-stripline device. The device may be packaged by folding solder-coated tabs, provided on the housing, around the dielectric substrate and heating the device such that the solder melts causing the housing to be secured to the substrate.

23 Claims, 9 Drawing Sheets

OTHER PUBLICATIONS

Wang et al., "Analysis and Synthesis Equations for Edge–coupled Suspended Substrate Microstrip Line", IEEE MTT–S Digest, pp. 1123–1126, 1989.

Tomar et al., "New Dispersion Models for Open Suspended Substrate Microstrips", IEEE MTS–S Digest, pp. 387–389, 1988.

Tomar et al., "Modelling The Dispersion in a Suspended Microstripline", IEEE MTS–S Digest, pp. 713–715, 1987.

Shu et al., "Analysis Equations for Shielded Suspended Substrate Microstrip Line and Broadside–Coupled Stripline", IEEE MTS–S Digest, pp. 693–696, 1987.

Tomar et al., "New Quasi–Static Models for the Computer–Aided Design of Suspended and Inverted Microstrip Lines", IEEE Transactions on Microwave Theory and Techniques, vol. MTT–35, No. 4, pp. 453–457, Apr. 1987.

Allen et al., "Broadside–Coupled Strips in a Layered Dielectric Medium", IEEE Transactions on Microwave Theory and Techniques, vol. MTT–20, No. 10, pp. 662–669, Oct., 1972.

Gish et al., "Characteristic Impedance and Phase Velocity of a Dielectric–Supported Air Strip Transmission Line with Side Walls", IEEE Trans. on Microwave Theory and Techs., vol. MTT–18, No. 3, pp. 131–148, Mar., 1970.

Krage et al., "The Characteristic Impedance and Coupling Coefficient of Coupled Rectangular Strips in a Waveguide", IEEE Trans. on Microwave Theory and Techs., vol. MTT–16, No. 5, pp. 302–307, May, 1968.

International Search Report, dated Mar. 23, 2004, from corresponding PCT application US 03/22955.

Tahara et al., "A Low–Loss Serial Power Combiner Using Novel Suspended Stripline Couplers," MTT–S International Microwave Symposium Digest, (May 20, 2001), Phoenix, Arizona, vol. 1 of 3, pp. 39–42.

Patent Abstract of Japan, Publication No. 62122301, published Jun. 3, 1987, for Japanese No. 60261023, application date Nov. 22, 1985, Hitachi Ltd.

* cited by examiner 32
5
30
38
34
52
38
36
5

32a
50
48
30
40
42
50
34
46
50
54
52
46
37
38
50
36
32b
48
50
34
40
50
42

SUSPENDED-STRIPLINE HYBRID COUPLER

BACKGROUND OF THE INVENTION

1. Field of the Invention

The present invention relates in general to coupled-line devices such as microwave hybrids, couplers and power dividers, especially such devices implemented using suspended-stripline technology. More particularly, the present invention relates to suspended-stripline microwave devices, and a method for manufacturing, and specifically to a suspended-stripline hybrid coupler.

2. Discussion of the Related Art

Many types of coupled line devices are known in the art, and may be manufactured using a variety of technologies. Two common technologies are microstrip and stripline. A stripline coupled-line device may include two conductive traces 25*a, b,* separated by a distance s and sandwiched between two dielectric substrates 26*a, b*, as shown in FIG. 1*a*. A ground plane 27*a, b* may usually be provided on the dielectric substrates. Microstrip coupled-line devices may include two conductive traces 25*a, b* disposed, spaced apart, on a dielectric substrate 26, as shown in FIG. 1*b*. A ground plane 27 may be disposed on an opposing side of the dielectric substrate. The coupling factor between the two conductors may depend on many factors, such as the distance s between the conductive traces 25*a, b*, the thickness and dielectric constant of the dielectric substrate 26, etc. The devices may be excited by an electromagnetic signal that may propagate in the conductive traces when the device is in operation. Typically, the electromagnetic signal may have a number of different modes, in particular an odd mode and an even mode. A problem that may be encountered with microstrip coupled-line devices is degrading of the coupling factor due to the unequal propagation velocities of the odd mode signal and the even mode signal in the device. One solution to this problem is to provide interdigitated "teeth" on the inner surfaces of the coupling section, to slow down the propagation velocity of the odd mode, as shown in FIG. 2.

Another type of coupled-line device is described in U.S. Pat. Nos. 4,547,753 and 4,641,111, which are herein incorporated by reference. These devices are formed using coaxial wire technology. They include an outer conductor and first and second inner wire conductors, at least one of which has insulation bonded thereto. The two inner conductors are separated by the thickness of the insulation. The device further includes an insulating sleeve disposed in the outer conductor. In order to overcome the aforementioned problem of non-uniform propagation velocities, a low-loss, material having a dielectric constant higher than that of the sleeve is provided between the inner wire conductors and between the pair of inner conductors and the outer conductor, to slow down the even mode. However, these devices may require hand-soldering of certain contacts, and may not be suitable for use with many pick-and-place machines that are often used to automatically populate circuit boards.

Suspended-stripline is similar in structure to ordinary stripline, but instead of disposing a ground plane 27 on the dielectric substrate, as in stripline, the dielectric substrate 26 is suspended in space, usually in air, between two ground planes 27*a, b*, as shown in FIG. 1*c*.

SUMMARY OF THE INVENTION

According to one embodiment, a suspended-stripline device comprises first and second conductive traces disposed on a dielectric substrate, each of the first and second conductive traces having a first edge and a second edge, and a housing at least partially surrounding the dielectric substrate. The device may include an input coupled to the first conductive trace, and an output coupled to at least one of the first and second conductive traces, wherein the second edge of each of the first and second conductive traces includes at least one outwardly extending protrusion.

In one example, the first and second conductive traces each include section having a predetermined length, and the at least one outwardly extending protrusion is located approximately at an end of the section. The predetermined length of the section may be, for example, approximately one quarter-wavelength corresponding to a center operating frequency of the suspended-stripline device. The size and orientation of the at least one outwardly extending protrusion may be selected so as to compensate for unequal even and odd mode propagation velocities through the suspended-stripline device.

According to another example, the section of the first conduction trace is located proximate and approximately parallel to the section of the second conductive trace. In yet another example, the second edge of at least one of the first and second conductive traces includes a plurality of outwardly extending protrusions distributed along a length of the second edge. The plurality of outwardly extending protrusions may be evenly distributed along the length of the second edge. The suspended-stripline device may have an insertion loss of less than approximately 0.2 dB.

According to another embodiment, a circuit in a suspended-stripline device comprises an input for receiving an input signal, an output for providing an output signal, a transmission line section located between the input and the output, and a lumped capacitance located at approximately one end of the transmission line section and connected between the end of the transmission line section and a reference potential. The lumped capacitance serves to compensate for differences in even and odd mode propagation velocities along the transmission line section.

In one example, the transmission line section may be approximately one quarter-wavelength long corresponding to a center operating frequency of the suspended-stripline device. The suspended-stripline device may have an insertion loss between the input and output of less than approximately 0.2 dB.

According to yet another embodiment, a suspended-stripline device comprises first and second conductive traces disposed on a dielectric substrate, and a housing at least partially surrounding the dielectric substrate. The device includes an input coupled to the first conductive trace, and an output coupled to at least one of the first and second conductive traces. An insertion loss between the input and the output is less than approximately 0.2 dB.

In one example, a dielectric constant of the dielectric substrate is in a range of approximately 2.1–3.5. In another example, each of the first and second conductive traces has a first edge and a second edge and the second edge includes at least one outwardly extending protrusion. The size and orientation of the at least one outwardly extending protrusion may be selected so as to compensate for unequal even and odd mode propagation velocities through the suspended-stripline device. According to yet another example, the first and second conductive traces each include a section having a predetermined length, and the at least one outwardly extending protrusion is located proximate an end of the section. The predetermined length of the section of the conductive traces may be approximately one quarter-wavelength corresponding to a center operating frequency of the suspended-stripline device.

According to yet another embodiment, a suspended-stripline device comprises a circuit disposed on a dielectric substrate, the circuit having an input for receiving an input signal, an output for providing an output signal, and at least one metal contact, and a metal housing at least partially surrounding the circuit, the housing including a plurality of tabs. The tabs are folded about the dielectric substrate so as to contact the at least one metal contact and electrically connected to the at least one metal contact. The height of the housing is selected so as to provide a predetermined volume of space between the dielectric substrate and a top portion of the housing.

A method of manufacturing a suspended-stripline device, according to one embodiment, comprises acts of disposing a circuit on a dielectric substrate, coating a selected piece of metal with solder, and forming a housing section out of the metal, the housing section having a predetermined shape including a plurality of tabs along an edge of the housing section. The method also includes acts of folding the plurality of tabs about an edge of the dielectric substrate and heating the housing section to a temperature sufficient to melt the solder, thereby causing the plurality of tabs to bond to a conductive trace on the dielectric substrate and securing the substrate to the housing.

According to another embodiment, a method of manufacturing a suspended-stripline device including a circuit disposed on a dielectric substrate, comprises acts of forming a metal housing section having a predetermined shape including a plurality of tabs along an edge of the housing section, and providing solder on at least one of the substrate and the plurality of tabs. The method also includes acts of folding the plurality of tabs about an edge of the dielectric substrate and heating the housing section to a temperature sufficient to melt the solder, thereby causing the plurality of tabs to bond to the substrate and secure the substrate to the housing.

In one example, the act of forming a metal housing section includes forming the housing section out of a piece of sheet metal. The act of providing solder may include coating at least a portion of the piece of sheet metal with a layer of solder.

In another example, the steps of folding and heating the tabs may be performed simultaneously, or during the same manufacturing run.

A further embodiment of a suspended-stripline device comprises first and second conductive traces disposed on a dielectric substrate, each of the first and second conductive traces having a first edge and a second edge, and a housing at least partially surrounding the dielectric substrate, a height of the housing selected so as to provide a predetermined volume of space between the dielectric substrate and the housing. The device also includes an input coupled to the first conductive trace, an output coupled to at least one of the first and second conductive traces, and means for compensating for unequal even and odd mode propagation velocities along the conductive traces.

In one example, the means for compensating may include means for reducing the even mode propagation velocity.

BRIEF DESCRIPTION OF THE DRAWINGS

The foregoing, and other objects, features and advantages of the device and method will be apparent from the following non-limiting description of various exemplary embodiments, and from the accompanying drawings, in which reference characters refer to like elements throughout the different figures. In the drawings.

DETAILED DESCRIPTION

Figure 3:
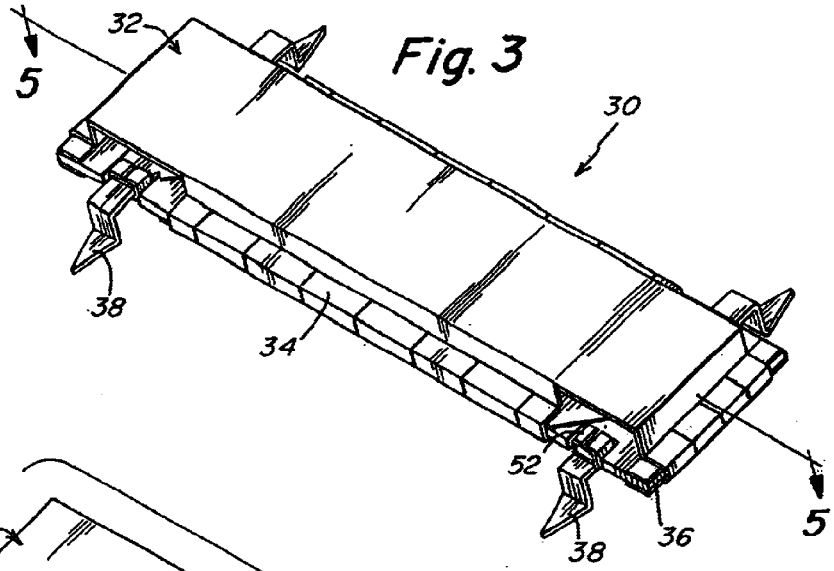
FIG. 3 is a perspective view of an exemplary embodiment of a suspended-stripline device according to the invention.

One embodiment of a suspended-stripline package according to the present invention is illustrated in FIG. 3. The device comprises a metal housing 32 that may include a number of interdigitated tabs 34. The tabs 34 may be folded around a dielectric substrate 36 to secure the housing to the dielectric substrate 36. A circuit, for example, a microwave hybrid coupler or power divider, may be disposed on the dielectric substrate 36. The device may be provided with a number of feet 38 which provide contact points, for example, an input or output, to the circuit disposed on the dielectric substrate 36. As will be discussed below, the device 30 has a number of advantageous properties, and is extremely easy to manufacture.

Figure 4:
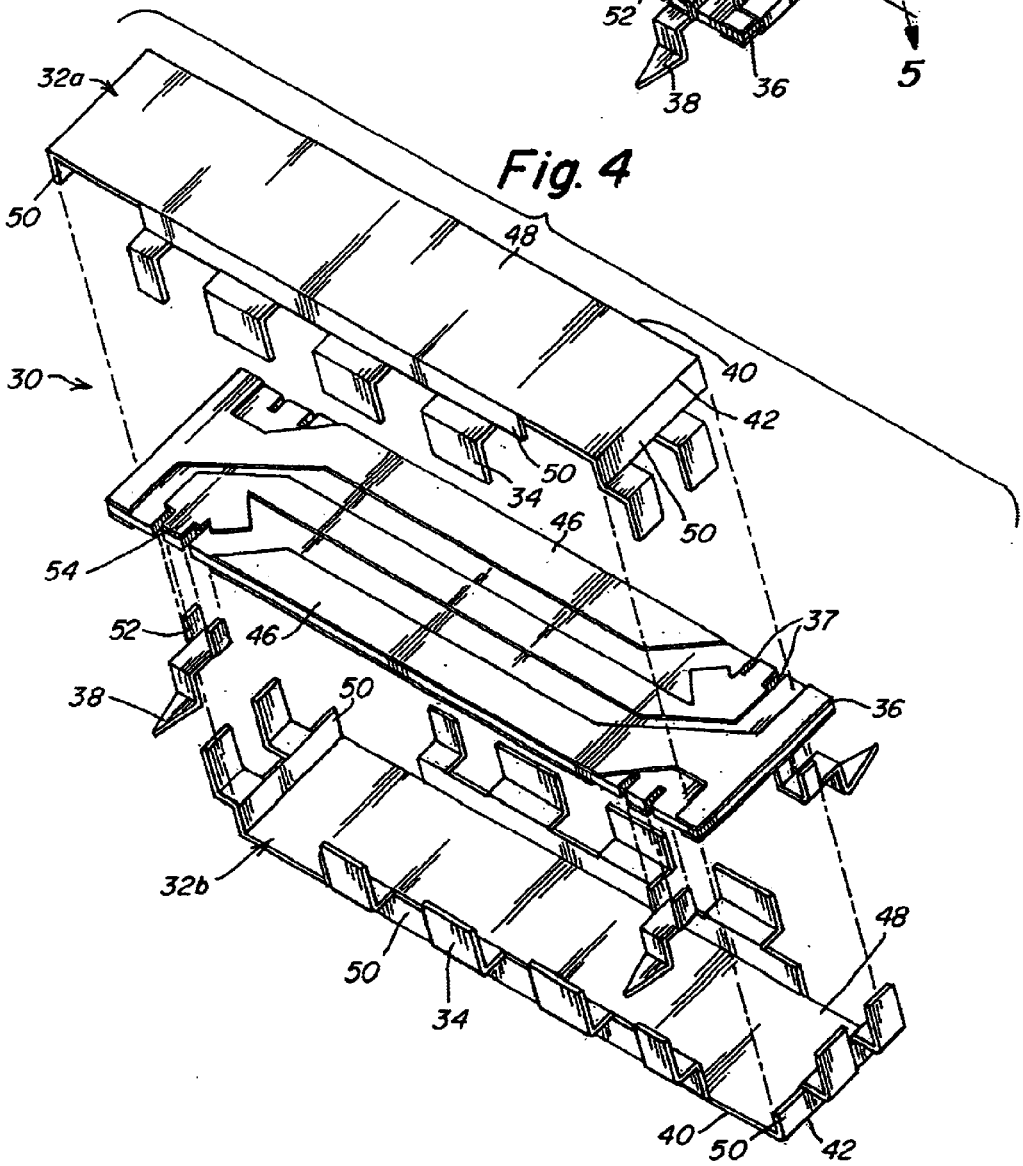
FIG. 4 is an exploded view of the suspended-stripline device of FIG. 3.
Figure 8:
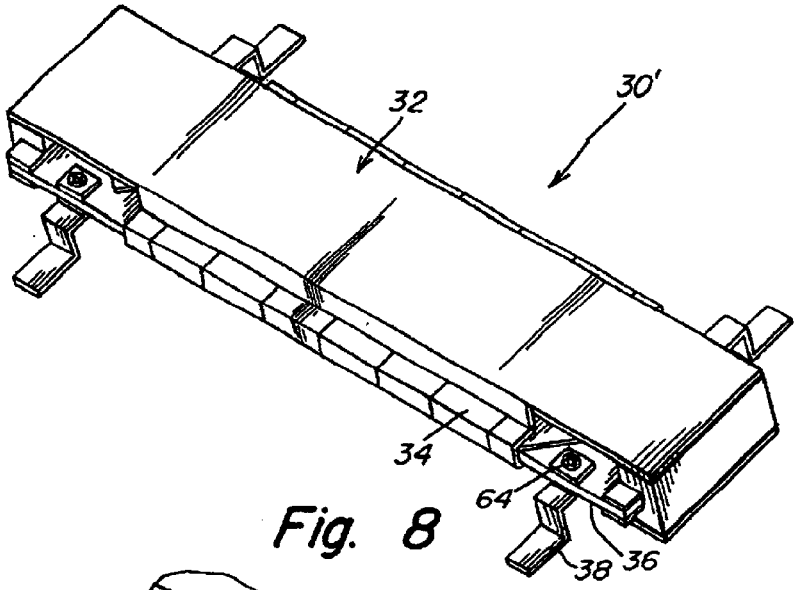
FIG. 8 is a perspective view of another embodiment of a suspended-stripline device according to the invention.

The construction of the device 30 may be more easily understood by referring to FIG. 4, which illustrates an exploded view of the device of FIG. 3. As illustrated, the housing 32 may include a top portion 32*a* and a bottom portion 32*b*. According to one embodiment, the top portion 32*a* and bottom portion 32*b* may be identical, and may include evenly spaced tabs 34, such that when bottom portion 32*b* is upside down with respect to top portion 32*a*, the tabs 34 from the top and bottom portions are interdigitated and may be wrapped around the dielectric substrate 36 to secure the housing to the substrate, as shown in FIG. 3. It is to be appreciated that although the housing portions 32*a* and 32*b* are illustrated with evenly spaced tabs 34, the device is not so limited, and the metal housing portions 32*a* and 32*b* may be provided with any number of tabs 34 which may or may not be evenly spaced, and which may be provided along all or some of the edges of the housing portions 32*a* and 32*b*. For example, FIG. 8 illustrates an alternative embodiment of a suspended-stripline device, where the tabs 34 are only provided along the longitudinal edges 40 of the metal housing, and not along the ends 42. In one example, solder 44 may be provided on all or some of the tabs 34. Alternatively, the entire housing portions 32*a* and 32*b* may be solder-plated, as may be the circuit traces (metallized portions) on the dielectric substrate 36. When the tabs 34 are folded about the dielectric substrate 36, the device may be heated under pressure such that the solder melts and forms an electrical and structural connection between the tabs 34 and metallized portion 46 of the dielectric substrate 36.

According to one embodiment, the metal housing portions 32*a* and 32*b* may include a body portion 48 and flange portions 50, which may be formed substantially perpendicular to the body portion 48. The flange portions 50 may be formed with a predetermined height, such that when the housing portions 32*a* and 32*b* are folded about the dielectric substrate 36, the body portion 48 is maintained at a predetermined height, the height of flange 50, from a surface of the dielectric substrate 36 (see FIG. 6*a*). Thus, a predetermined volume of space, which may be typically filled with air, is maintained between the surface of the dielectric substrate 36 and the body portion 48 of the housing, and thus between any circuit disposed on the dielectric substrate and the metal housing. In this manner, the suspended-stripline structure, i.e., the dielectric substrate 36 suspended in air, is achieved.

According to another example, the feet 38 may also include tabs 52 that may be used to connect the feet to the dielectric substrate 36. Analogous to the tabs 34 of the metal housing 32 being wrapped around the substrate, tabs 52 of the feet 38 may be wrapped around a metallized portion 54 provided on dielectric substrate 36 to secure the feet to the substrate. As illustrated, the dielectric substrate 36 may include slots 37 to allow the tabs 52 to be wrapped around the substrate. In one example, solder may be provided on the tabs 52 such that once the tabs 52 are wrapped around the corresponding metallized portion 54, the device may be heated under pressure to melt the solder thereby forming an electrical and structural connection between the feet 38 and the metallized portion 54. Alternatively, as described above, all metal portions of the device, including the feet 38 may be solder-plated, rather than providing solder on only selected portions of the device. In the illustrated embodiment, the feet 38 are illustrated as being tapered. However, it is to be appreciated that the feet may not be tapered and may be substantially rectangular.

Figure 5:
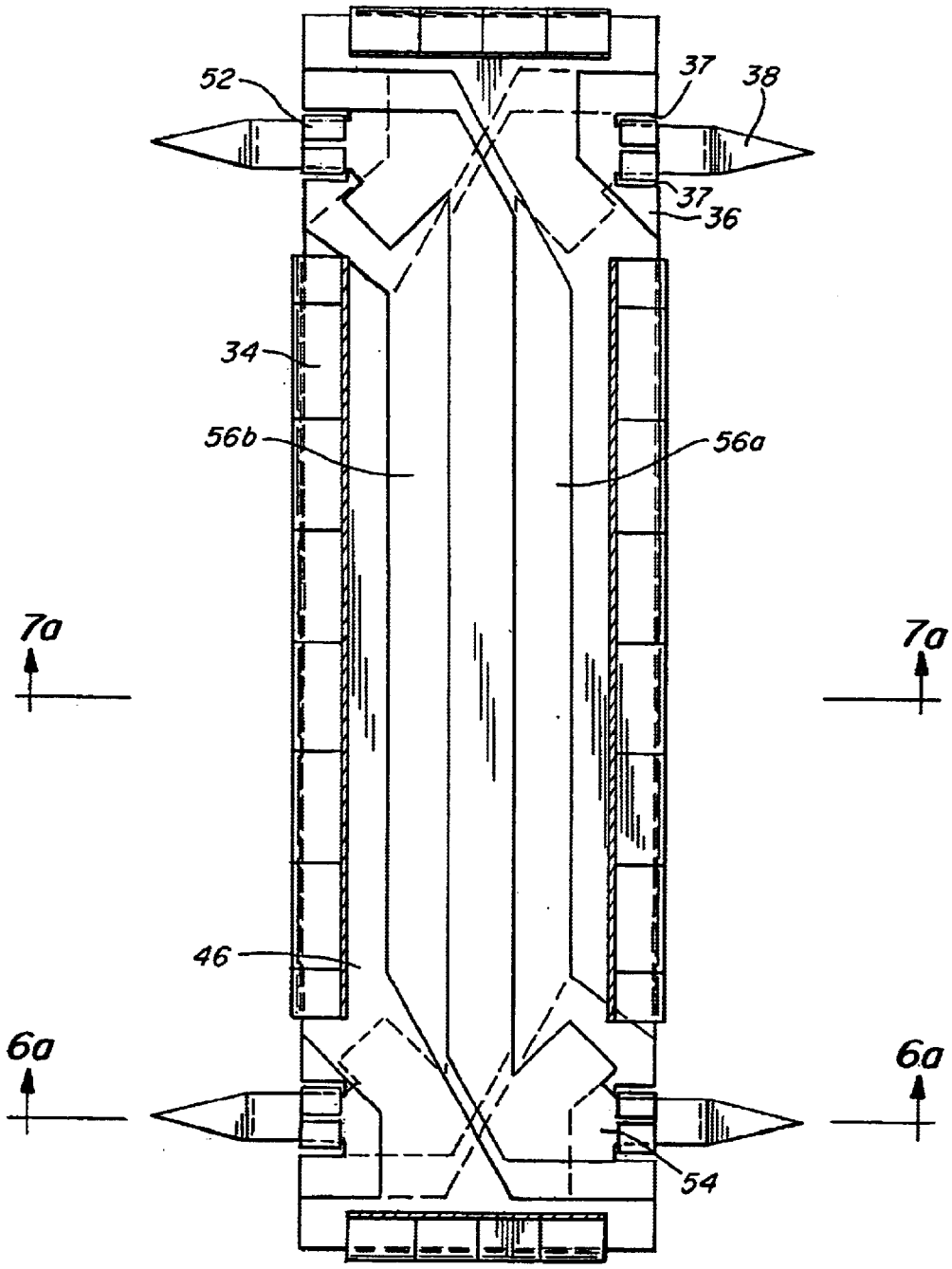
FIG. 5 is a top plan view of the suspended-stripline device of FIG. 3, taken along line 5—5 FIG. 3.

Referring to FIG. 5, there is illustrated a top plan view of the suspended-stripline device of FIG. 3, taken along arrow line 5—5. FIG. 5 illustrates the tabs 34 of the housing in contact with metallized portions 46 of the dielectric substrate 36, and tabs 52 of the feet 38 in contact with metallized portions 54. The dielectric substrate 36 shown in FIG. 5 includes etched portions 56*a*, 56*b* and metallized portions 46, 54, forming one embodiment of a microwave device that may be implemented using the suspended-stripline technology described herein. This circuit structure will be discussed in more detail infra. It is to be appreciated, however, that this is merely one embodiment of one microwave device, namely a hybrid coupler, that may be implemented using this technology, and the device is not so limited.

Figure 6A:
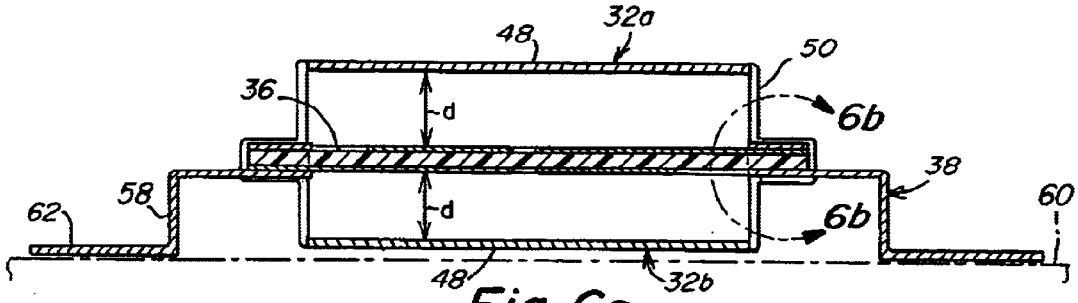
FIG. 6*a* is a transverse cross-sectional view of the suspended-stripline device of FIG. 3, taken along line 6*a*—6*a* of FIG. 5.
Figure 7A:
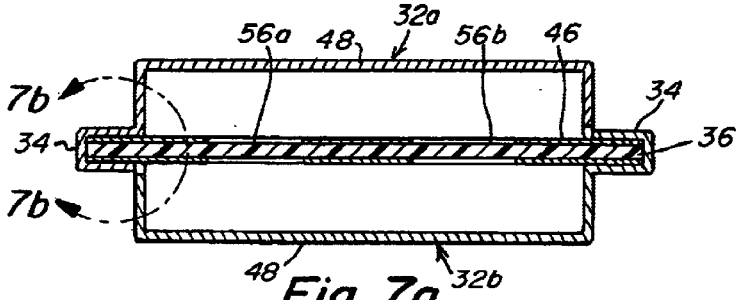
FIG. 7*a* is a transverse cross-sectional view of the suspended-stripline device of FIG. 4, taken along line 7*a*—7*a* of FIG. 5.

The structure and construction of the suspended-stripline device may be further understood by referring to FIGS. 6*a*, 6*b*, 7*a* and 7*b* which illustrate cross-sectional views of the device of FIG. 3 taken along arrow lines 6*b*—6*b* (FIGS. 6*a* and 6*b*) and along arrow lines 7*b*—7*b* (FIGS. 7*a* and 7*b*) of FIG. 5. As shown in FIGS. 6*a* and 7*a*, the flange portions 50 of the upper and lower portions of the metal housing 32*a*, 32*b* maintain the body portion 48 of the housing at a predetermined distance d from the surface of the dielectric substrate 36. This distance d may be chosen based on desired operating characteristics of the circuit disposed on dielectric substrate 36, and size requirements for the device.

According to one example, illustrated in FIG. 6*a*, the feet 38 may include bent portions 58 and contact portions 62, such that when contact portions 62 are in contact with, for example, soldered to, a circuit board or substrate 60, the bent portion 58 maintains the body of the device above the surface of the circuit board with any substrate 60. According to another example, the bottom portion 32*b* of the metal housing may also be in contact with the surface of the circuit board or with any 60, and may be soldered to, for example, a ground connection of the circuit board or substrate 60.

Figure 6B:
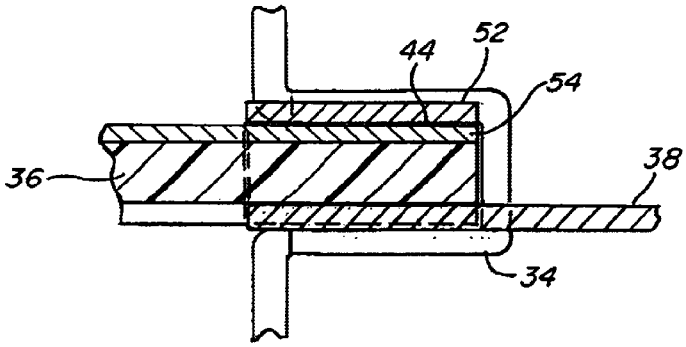
FIG. 6*b* is an enlarged view of the area and encircled by line 6*b*—6*b* of FIG. 6*a;*

Referring to FIG. 6*b*, there is illustrated in more detail a portion of the device of FIG. 6*a*, lines arrows 6*b*—6*b*. As discussed above, tabs 52 of the feet 38 may be wrapped around and soldered to a corresponding metallized portion 54 of the dielectric substrate 36 to secure the feet 38 to the device. The feet 38 protrude from the device through spaces between the tabs 34 (see FIG. 3). It is to be appreciated, however, that using feet with tabs 52 is only one, non-limiting embodiment of the suspended-stripline device of FIG. 3.

Figure 7B:
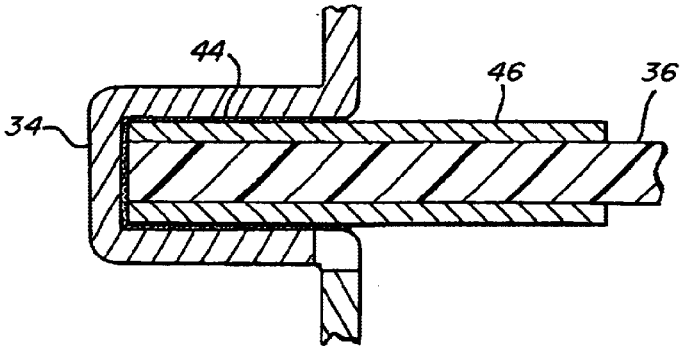
FIG. 7*b* is an enlarged view of the area encircled by 7*b*-7*b* of FIG. 7*a;*

FIG. 7*b* illustrates in more detail a section of the suspended-stripline device encircled by arrows 7*b*—7*b* in FIG. 7*a*. As discussed above, the tabs 34 of metal housing 32 are wrapped around and soldered to a metallized portion 46 of the dielectric substrate 36. It is to be appreciated that the tabs 34 may be wrapped around the dielectric substrate 36 without soldering. However, the solder eliminates problems of thermal expansion and possible stingent requirements on the pressure needed if the pads were wrapped without solder. Non-linear surface junctions may occur between dissimilar metals, and these non-linear junctions may generate undesirable passive intermodulation products when excited with an electromagnetic field. Therefore, it may be advantageous to use compatible metals for the tabs 34, feet 38, and metallized portions 46 and 54 of the device in order to avoid these junctions occurring. In one example, the feet, metal housing and metallized portions of the circuit may be formed from copper and may be solder-plated, such that they are all compatible. However, it is to be appreciated that any type of metal may be used, and the device is not limited to using solder-plated copper.

Figure 9:
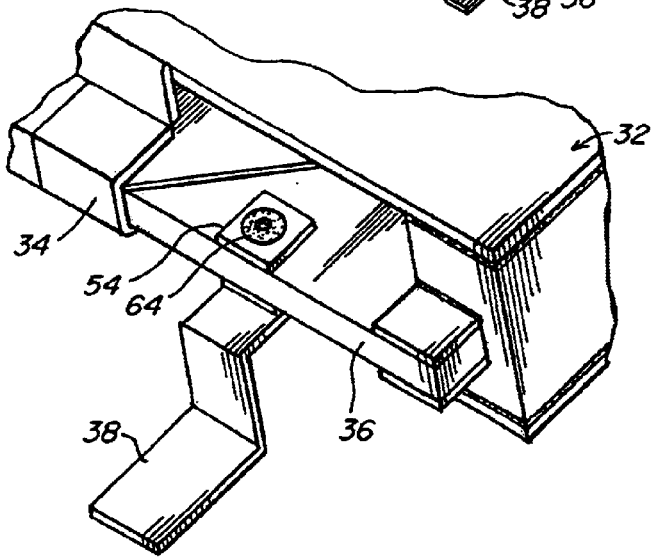
FIG. 9 is an enlarged fragmentary perspective view of the suspended-stripline device of FIG. 8.

Referring to FIG. 8, there is illustrated an alternative embodiment 30' of the device where the feet 38 are attached to the dielectric substrate 36 using through-plated via holes 64. In this example, the housing is provided with tabs 34 only along the longitudinal edge, and not along the ends. However, it is to be appreciated that the positioning of the tabs 34 is not related to the manner in which the feet 38 are attached. Thus, the device may include a housing having tabs along any or all edges (as shown in FIG. 3), and may have feet attached with tabs or vias. A portion of the device of FIG. 8 is illustrated in more detail in FIG. 9, showing a foot 38 attached to the dielectric substrate 36 using a through-plated via hole 64.

One exemplary embodiment of a microwave device that may be implemented using the suspended-stripline package and structure described above will now be described in detail. However, it is to be appreciated that this device, namely a 90° hybrid coupler, is one example of a device that may be implemented using this technology, and many circuits and devices may be possible, for example, 2–1 power dividers, 4–1 power dividers, etc.

Figure 10:
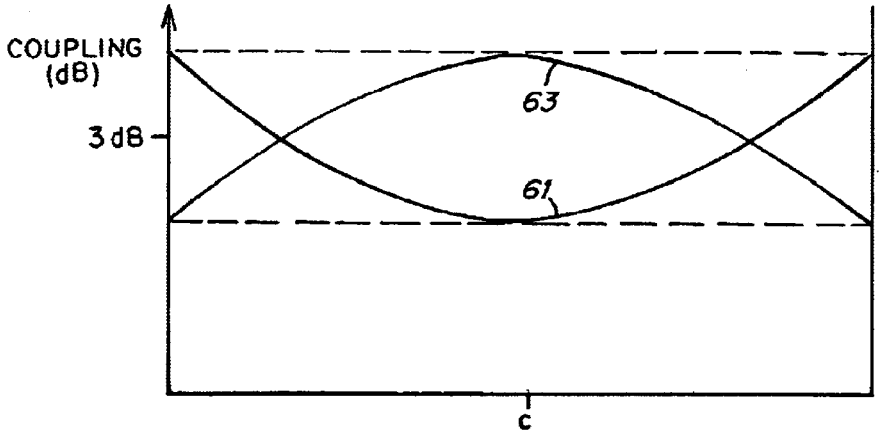
FIG. 10 is a diagrammatic representation of a graph of coupling factor vs. frequency for a conventional 3 dB microwave coupler.
Figure 11:
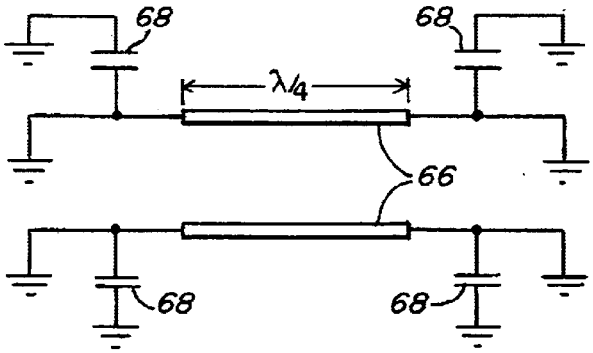
FIG. 11 is a schematic diagram of a hybrid coupler device that may be implemented using suspended-stripline technology according to the invention.

Important factors in the design and performance of a microwave coupler may be the coupling factor between the input port and the coupled output port, and the isolation between the two output ports. Referring to FIG. 10, over a broad frequency band, for example, an octave of frequency, a curve 61 graphing the coupling from the input port to the coupled output port may typically have a parabolic shape, while a curve 63 of the through-power from the input port to the through output port may have an inverse parabolic shape. Thus, there is generally some region where the two parabolas overlap, the center of this overlapping portion being approximately 3 dB, as shown in FIG. 10. The coupling is typically designed to be higher than 3 dB for the center frequency c so as to expand the overlap region and achieve a wide frequency band. The frequency band is determined by the acceptable tolerance above and below 3 dB of coupling. In order to achieve this, sections of the coupler are designed to be approximately one-quarter wavelength at the center frequency, as illustrated in FIG. 11.

Figure 1A:
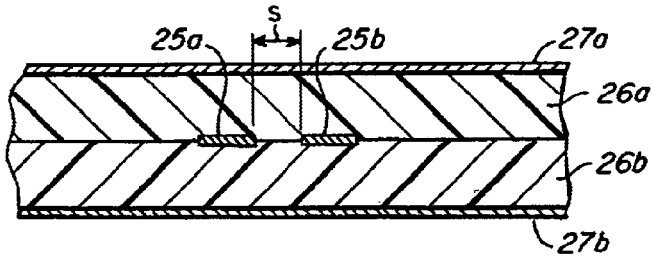
Fig. 1a RELATED ART
FIG. 1*a* is a cross-sectional view of a conventional stripline structure.
Figure 1B:
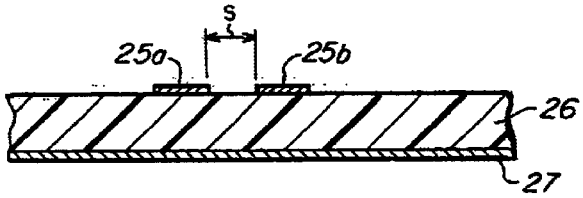
Fig. 1b RELATED ART
FIG. 1*b* is a cross-sectional view of a conventional microstrip structure.
Figure 1C:
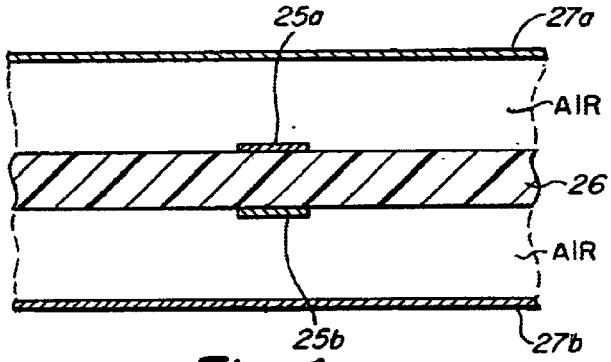
Fig. 1c RELATED ART
FIG. 1*c* is a cross-sectional view of an exemplary suspended-stripline structure.
Figure 2:
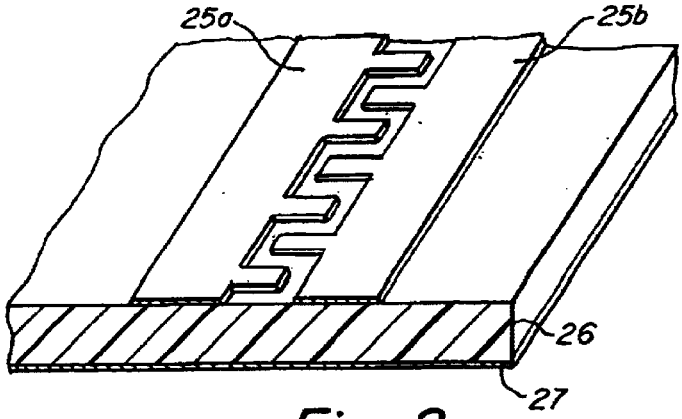
Fig. 2 RELATED ART
FIG. 2 is an example of a section of a microstrip coupled-line device including interdigitated "teeth" provided on inner edges of the conductive traces

The isolation between the two output ports is generally not parabolic, but tends to have a notch shape about the center frequency. Good isolation between the two ports may be important in order to avoid any mixing between the ports which may generate spurious intermodulation products which may disrupt or degrade performance of the entire device in which the coupler is used. Typically, greater than 23 dB isolation may be required to achieve a desired output. The shape of the isolation curve may be determined, at least in part, by the implementation, and may be largely determined by the difference in propagation velocity between the even and odd modes of the electromagnetic field in the coupler. Ideally, the propagation velocity may be the same for both the even and odd modes, which may be achieved by using a uniform or homogenous dielectric substance. However, as suspended-stripline is not a homogenous structure (because one conductor has the dielectric substrate below it and air above it, while the other conductor has air below and dielectric above, as shown in FIG. 2), the even and odd modes of propagation experience different effective dielectric constants. Therefore, the propagation velocity of the even and odd modes of the electromagnetic field propagating in the coupler may be different. In order to achieve good, wide-band isolation, this difference in the propagation velocities of the even and odd modes needs to be compensated for. The better the compensation, the more wide band the isolation may be.

As discussed above, for couplers designed using microstrip technology, which is also an asymmetric structure, the problem of degraded coupling factor due to unequal propagation velocities of the odd mode and even mode signals through the device. In microstrip, the odd mode tends to propagate more quickly than the even mode. Therefore, instead of having straight coupling sections, interdigitated "teeth" may be formed on the inner surface of the coupling section, to slow down the propagation velocity of the odd mode, as shown in FIG. 2. However, in couplers designed using suspended-stripline, the odd mode may propagate more slowly than the even mode, and therefore, the even mode may need to be slowed down.

Figure 12A:
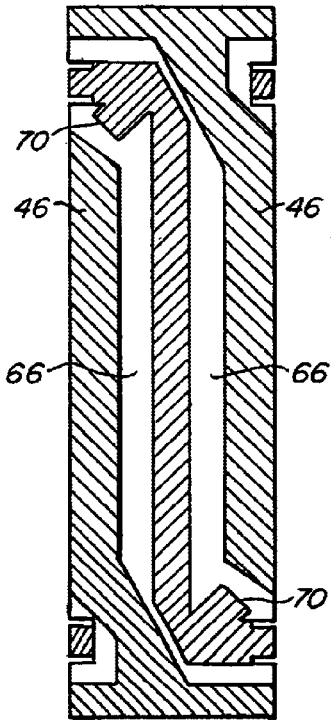
FIG. 12*a* is a schematic plan view of the conductive trace pattern of one embodiment of the hybrid coupler device of FIG. 11.
Figure 12B:
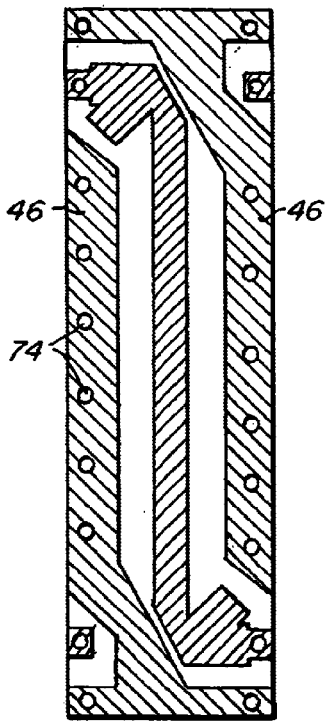
FIG. 12*b* is a schematic plan view of the conductive trace pattern of another embodiment of the hybrid coupler device of FIG. 11, including via holes.
Figure 12C:
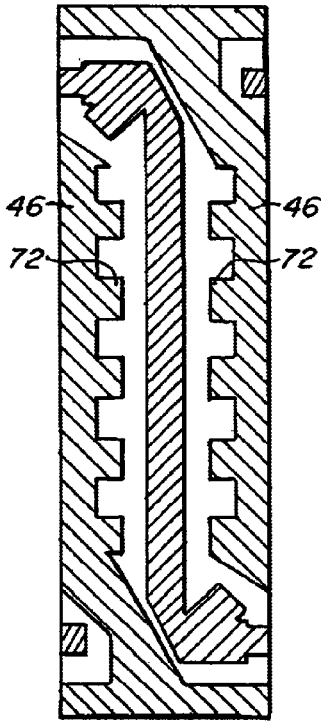
FIG. 12*c* is a schematic plan view of the conductive trace pattern of yet another embodiment of the hybrid coupler device of FIG. 11.

Referring to FIGs. 12*a–c*, according to one embodiment, protrusions 70 may be formed on an outer edge of the coupling section, because the even mode tends to propagate on the outside of the conductors while the odd mode propagates on the inside. In one example, which may be implemented at frequencies from approximately 1.7 GHz, to approximately 2.4 GHz, known as the "3G" range, the protrusions may be provided as a single protrusion located on either end of the coupling sections 66, thus forming a static capacitance 68 on either end of the coupling sections 66, as shown in FIG. 11. This capacitance 68 may slow down the even mode, resulting in the even and odd modes propagating at approximately the same equivalent speed through the coupler. It is to be appreciated that providing the protrusions 70 at the ends of the coupling sections, as capacitance at either end, could not be done with a microstrip design because in microstrip the odd mode propagates more quickly. Thus, providing capacitance that slows down the even mode would result in an even large disparity between the propagation velocities of the even and odd modes, rather than compensating for the difference. In another embodiment, illustrated in FIG. 12*c*, distributed protrusions 72 may be provided along the length of the coupling sections. It is to be appreciated that the number, size and distribution of the protrusions need not be as illustrated, for example, the protrusions 72 need not be evenly spaced along the length of the coupling sections 66. It is further to be appreciated that a combination of the examples shown in FIGs. 12*a* and 12*c* may be implemented, i.e. protrusions 70 may be provided at the ends of the coupling sections in addition to one or more protrusions 72 being provided somewhere along the length of the coupling sections 66. The number, size and distribution of the protrusions may be empirically determined based on a measured and desired performance of the device. According to one example, a coupler constructed as described above may have an isolation of greater than approximately 23 dB over a frequency range of approximately 1.7 GHz–2.5 GHz.

As discussed above, the metal housing for the device may be provided with tabs 34 (see FIGS. 1–5) which wrap around the dielectric substrate 36 and attach the housing to the substrate. The tabs 34 may contact metallized portions 46 of the dielectric substrate 36. In the examples shown in FIGS. 12*a–c*, the metallized portions 46 may form part of a ground plane for the circuit disposed on the dielectric substrate. Thus, the housing itself may provide an electrical connection between an upper ground plane (metallized portions 46) of the circuit and a lower ground plane disposed on the reverse side of the substrate. According to another example, illustrated in FIG. 12*b*, the metallized portions 46 may include through-plated via holes 74 which may provide electrical connection between an upper ground plane (metallized portions 46) and a lower ground plane on the underside of the substrate (not shown).

The dielectric substrate 36 upon which the conductors are disposed may be any type of dielectric material commonly used, such as, for example, Teflon-based materials, or Rogers Duroid™, or Nelco™. Higher dielectric constant materials typically result in physically shorter quarter-wavelength sections, for the same center frequency, thus resulting in a smaller device. However, higher dielectric constant materials may also have higher loss, and may also result in a greater difference between the propagation velocities of the even and odd modes. This may result in more compensation being required which may mean a higher capacitance, or larger or more protrusions 70, 72. The dielectric substrate 36 may have a dielectric constant in a range from approximately 2.1 to 10.5. In a preferred embodiment, for example, for 3 dB coupler applications, the dielectric substrate 36 may have a dielectric constant in a range of approximately 2.1 to 3.5.

Figure 13:
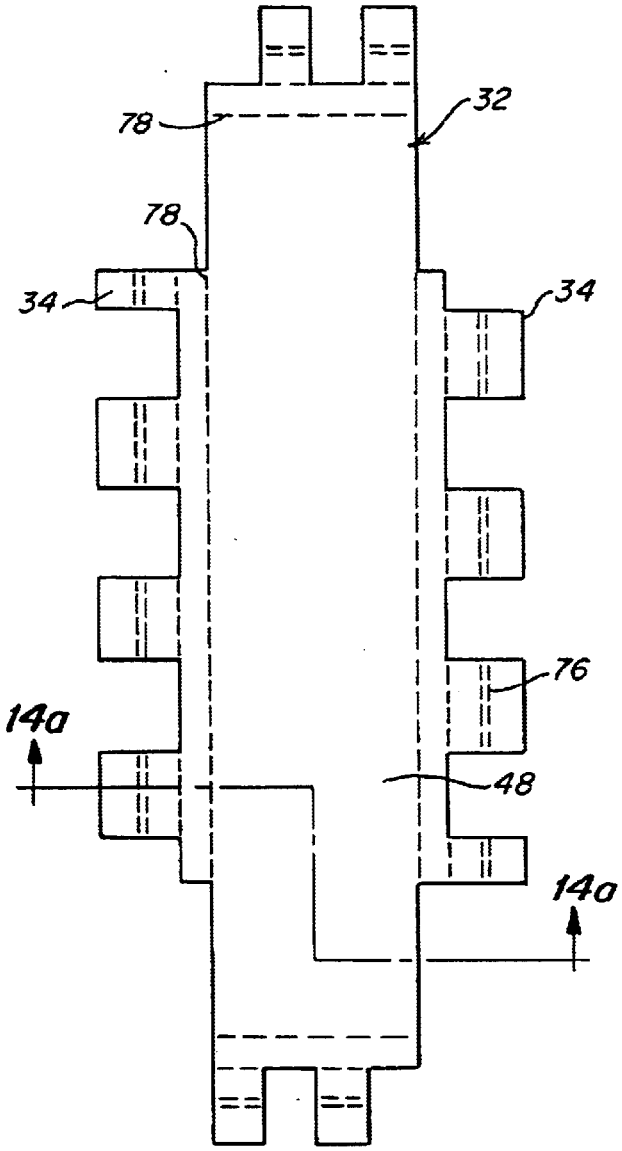
FIG. 13 is a top plan view of a portion of a metal housing according to the invention.

According to one example, the device implemented using the suspended-stripline package of FIG. 4, and the conductive trace pattern of FIG. 13, may be a 90° hybrid microwave coupler. This device may have several significant advantages over a conventional stripline coupler. For example, in suspended-stripline technology, the dielectric substrate may be suspended in air, and thus the conductive traces disposed on the substrate have air above them, as opposed to conventional stripline in which the conductive traces are sandwiched between two layers of dielectric substrate. Because air has a lower dielectric constant, and lower loss factor than other known dielectric materials, an electromagnetic field propagating on the conductive traces of the device experiences lower loss compared with a conventional device. Therefore, this device may have a lower insertion loss, measured at a same frequency, than a conventional device. In one example, the device described herein may have an insertion loss of less than approximately 0.1 dB (compared with approximately 0.25–0.3 dB for a similar conventional device) over an operating frequency range of approximately 1.7 GHz–2.5 GHz. As a result of this low insertion loss, the device may have significantly improved power handling capacity because it has considerably less thermal loss. This advantageous property allows the dielectric substrate to be chosen from relatively soft materials, such as fiberglass. Conventional stripline devices that are used for high power applications tend to require the dielectric to be a ceramic, which can cause problems of disconnection or delamination in circuits due to differences in the thermal characteristics of ceramics and other softer dielectric materials, such as those from which the circuit board to which the device is being connected may be made from. These problems may be avoided with the suspended-stripline device described herein because the need for ceramic materials is removed by the improved power handling capacity of the device.

Although the presence of the air dielectric may tend to increase the size of the device as compared to conventional stripline devices, this is not necessarily a disadvantage. In one example, the device may be constructed to have a size that corresponds to conventional FET spacing on many common printed circuit boards. Smaller conventional devices may require long, meandering conductive traces to connect feet of the devices to pads of the FETs, which may be eliminated by designing the present device to match the FET spacing. Furthermore, careful choice of the dielectric substrate 36 and spacing d (see FIG. 7*a*) may allow control and adjustment of the size of the device. In one non-limiting example, the device may have a length of approximately 1.5", a width of approximately 0.72" and a height of approximately 0.125".

Some exemplary embodiments for a method of manufacturing the above-described device will now be discussed in detail. It is to be appreciated that the method may be used to manufacture any type of circuit implemented with the suspended-stripline package described above. The method may be a high-volume, automated method that requires very little operator intervention, and may require no hand-soldering of any part of the device. An advantage of such a method is that it may be low cost and fairly speedy.

Figure 14A:
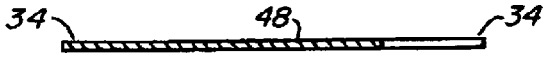
FIG. 14*a* is a transverse cross-sectional view of the housing of FIG. 13, taken along line 14*a*—14*a;*
Figure 14B:
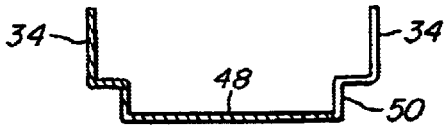
FIG. 14*b* is the cross-sectional view the housing of FIG. 14*a* preformed into a desired shape.
Figure 15:
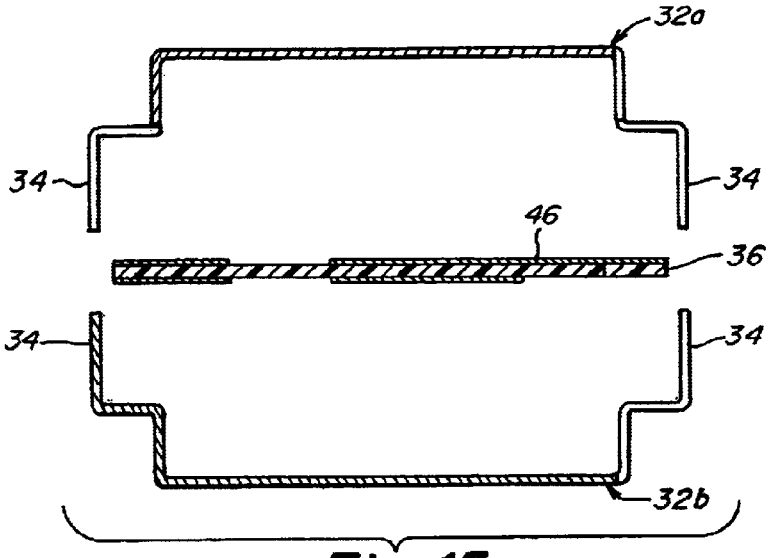
FIG. 15 is an exploded cross-sectional view of top and bottom portions of the housing and a dielectric substrate forming a suspended-stripline device according to the invention.

Referring to FIGs. 13, 14*a* and 14*b*, there is illustrated an exemplary embodiment of a portion (top or bottom, since they may be identical) of the metal housing 32 (see FIG 5). The housing 32 may be formed from a piece of metal, for example, sheet metal, which may be cut or stamped into a desired shape, for example, the shape illustrated with a number of tabs 34 provided around edges. In one example, the housing 32 may be solder-plated, as discussed above. For example, th piece of metal from which the housing is to be formed may be solder-plated, or may have solder applied to selected areas, prior to being cut or stamped into the shape of the housing section. An advantage of this is that it may simplify the manufacturing procedure of the device since the solder will automatically be in the correct positions when the bowing is formed. The solder may be applied using a solder bath, or by any known techniques. Hand-soldering may not be required, although the housing may be hand-solder. According to another example, solder may be applied only to selected portions of the housing 32, for example, the tabs 34. Once the solder 44 has been applied, the housing may be preformed into a desired shape, i.e., the tabs may be folded or bent along the dotted lines 76 (see FIG. 13), as shown in FIG. 14*b*. The housing may also be folded along dotted in 78 (see FIG. 14*b*), to provide the flange portions 50 (see FIG. 4) These steps may all be automated and require minimal operator intervention.

Figure 16:
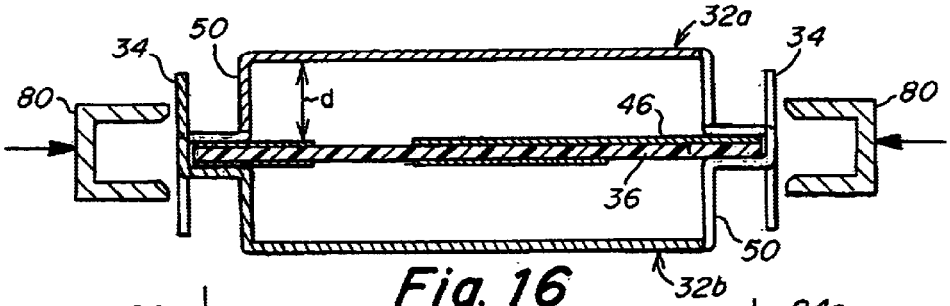
FIG. 16 illustrates the housing portions of FIG. 15 being wrapped around the dielectric substrate.
Figure 17:
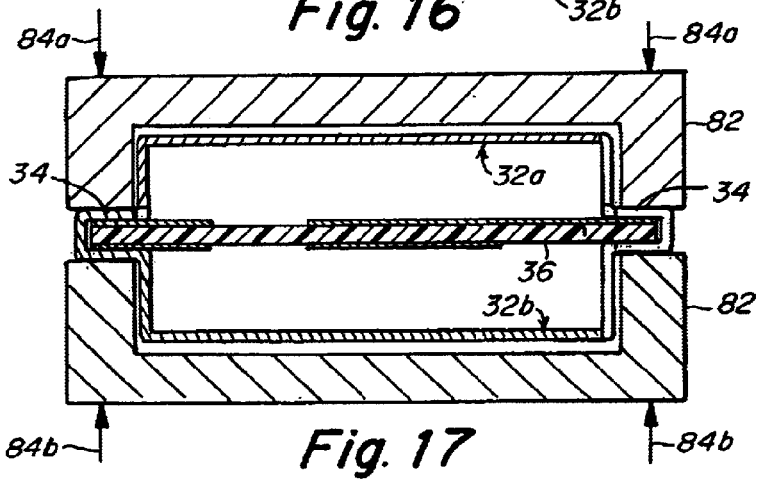
FIG. 17 illustrates heat and pressure being applied to the device to seal the housing of FIG. 16.
Figure 18:
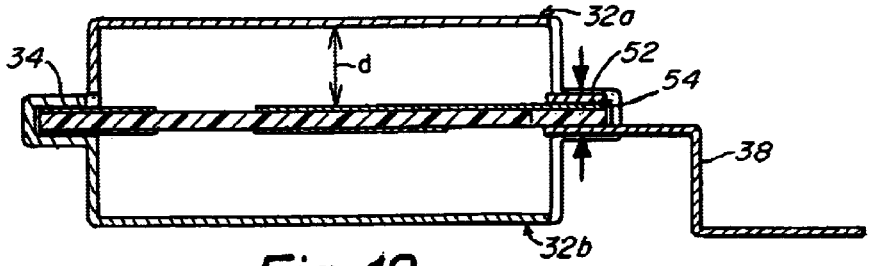
FIG. 18 illustrates a foot being attached to the suspended-stripline device of FIG. 17.

Referring to FIGS. 15–18, the housing 32 may be placed in position above and below the dielectric substrate 36, and the tabs 34 may be wrapped around the dielectric substrate, interleaved with one another, as described above. According to one embodiment, the tabs 34 may be wrapped, pressed down and heated to melt the solder and form a good electrical and structural bond, in a single operation, for example, using tool 80, as shown in FIG. 16. Alternatively, the tabs may be wrapped by tool 80, and pressure and heat may be applied during a second operation, using tool 82. In this example, tool 82 applies pressure in the directions of arrows 84*a* and 84*b*, as shown in FIG. 17. As discussed above, for suspended-stripline devices it may be important that a predetermined spacing d be maintained between the housing and a surface of the dielectric substrate. Preforming the housing with flange portions 50 (see FIG. 14*b*) provides that when the housing is placed about dielectric substrate 36, this spacing is automatically maintained. However, it may also be important to control the pressure during the wrapping procedure, and the thickness of the solder applied, as variations in these parameters may cause slight variations in the spacing d, which may be undesirable.

The feet 38 may be attached to the dielectric substrate by wrapping the tab portions 52 about a corresponding metallized portion of the dielectric substrate 36. In some applications it may be important that feet, or in an alternative example, contact pads, be isolated from a ground pad of the device, which may be where the tabs are attached. It may further be important that the feet and ground pad (tabs) be soldered during a single operation in order to avoid any re-melting of the solder which may occur if some connections were to be soldered before others. Therefore, the tabs 34 and the feet tabs 52 may be wrapped about the respective portions of the dielectric substrate, and heat and pressure may be applied to the entire device in a subsequent step, for example, as shown in FIG. 17. It is to be appreciated that the wrapping procedure may eliminate the need for through-plated vias connecting upper and lower surface metallizations on the dielectric substrate. However, as discussed above, in some embodiments, vias may still be provided.

Figure 19:
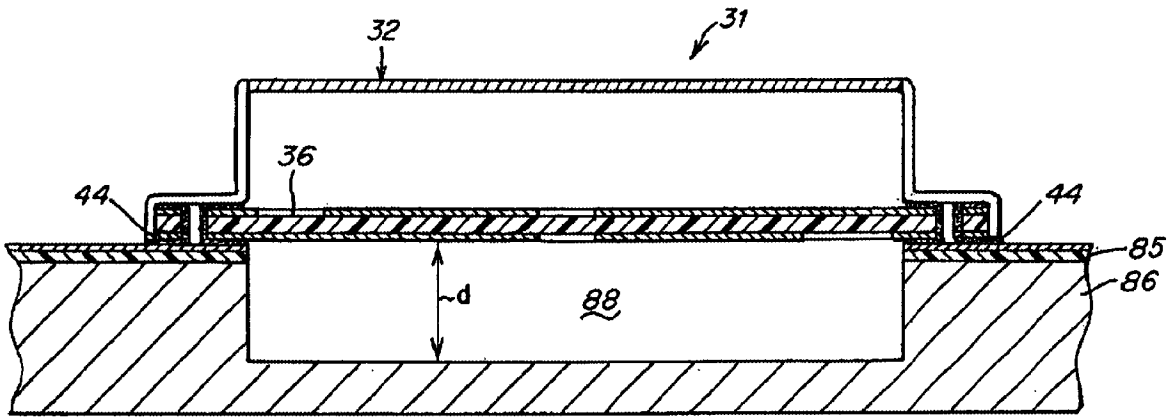
FIG. 19 is a cross-sectional view of another embodiment of suspended-stripline device according to the invention, having only a top portion of the housing.

Referring to FIG. 19, there is illustrated another embodiment of a suspended stripline device 31 mounted on a metal-backed substrate 85. In this embodiment, the metal 86 may be formed with a recess 88 that may have a depth substantially equal to the predetermined distanced between the surface of the dielectric substrate 36 and the housing 32. In one example, the metal may be Aluminum. However it is to be appreciated that many other metals may be suitable alternatives, as known to those of skill in the art. Thus, because the metal 86 itself acts as the bottom portion of the housing, only the top portion of the metal housing need be provided about the device. Instead of providing feet 38, the device may include contact pads (not shown) that may have solder 44 applied thereto, to solder the contact pads to corresponding metallized pads on the substrate surface, thereby firmly attaching the device 31 to the substrate 85. In the illustrated example, the device is attached by means of through-plated via holes 45. Again, in this embodiment, any desired conductive trace pattern may be disposed on the dielectric substrate 36.

Figure 20:
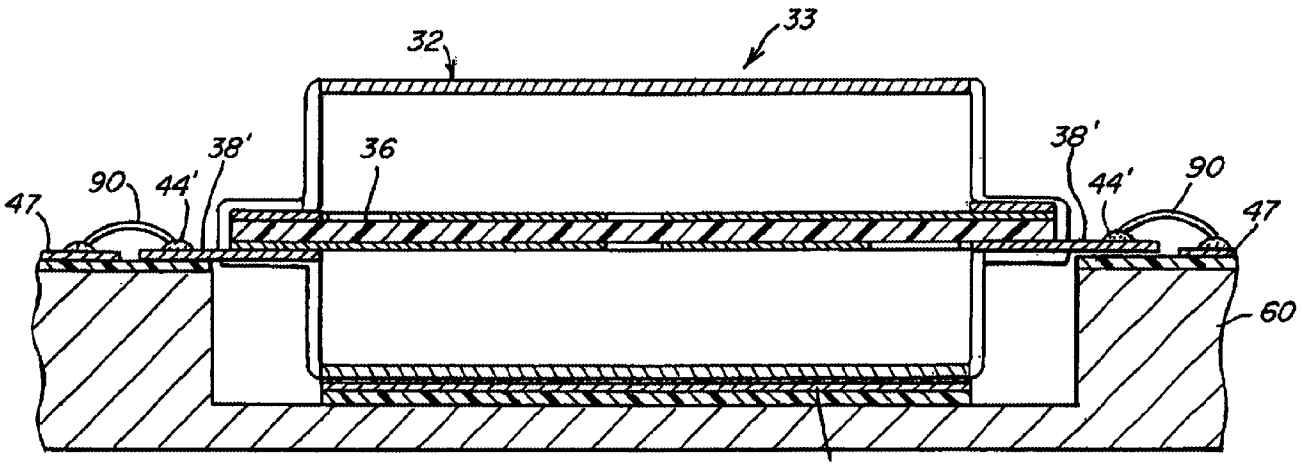
FIG. 20 is another embodiment of a suspended-stripline device according to the invention.

Having thus described various illustrative embodiments and aspects thereof; modifications, alterations and improvements may be apparent to those of skill in the art. For example, as discussed previously, the suspended-stripline package described herein may be used to provide many different devices, such as, but not limited to, hybrid couplers, power dividers, power combiners etc. Additionally, although the device is illustrated as being rectangular, it need not be. For example, the device may be hexagonal or octagonal, or any other shape as desired. It is also not necessary that the feet be provided at 900° to the edges of the device, or on alternate sides as illustrated. The feet may be placed anywhere around a perimeter of the device, and may be all on one side, some on one side and some on another, at different angles, etc. The feet also do not need to be tabs, and may be buttons, posts surrounded by an insulating material with a small metallic base exposed, contact pads, etc. For example, referring to FIG. 20, there is illustrated an exemplary device 33 where the feet 38' extend substantially parallel to the dielectric substrate 36, and may be provided with solder 44' allow attachment of bond wires 90 that may be connected to terminals 47 of other devices. Also, the bottom of the housing 32*b* may be soldered to a metallized portion 92 (for example ground pad) of a circuit board or metal-backed substrate 60. These and other variations, alterations and modifications are intended to be within the scope of the present disclosure, which is for purposes of illustration only, and is not intended to be limiting. Accordingly, the scope of the invention should determined from proper construction of the appended claims, and their equivalents.

What is claimed is:

1. A suspended-stripline device comprising:

first and second conductive traces disposed on a first surface and second surface, respectively, of a dielectric substrate, each of the first and second conductive traces having a first edge and a second edge, and each of the first and second conductive traces having a section of predetermined length along a lengthwise dimension;

a housing at least partially surrounding the dielectric substrate, wherein air resides between the housing and at least a portion of at least the first conductive trace;

an input coupled to the first conductive trace; and an output coupled to at least one of the first and second conductive trace, wherein the second edge of each of the first and second conductive traces includes at least one outwardly extending protrusion, and wherein a plane parallel to the lengthwise dimension and orthogonal to the first and second surfaces intersects the sections of the first and second conductive traces.

2. The suspended-stripline device as claimed in claim 1, wherein, for at least one of the first and second conductive traces, the at least one outwardly extending protrusion is located approximately at an end of the section.

3. The suspended-stripline device as claimed in claim 1, wherein, for at least one of the first and second conductive traces, the predetermined length of the section is approximately one quarter-wavelength corresponding to a center operating frequency of the suspended-stripline device.

4. The suspended-stripline device as claimed in claim 1, wherein the plane intersects an approximate lengthwise axis of the sections of the first and second traces.

5. The suspended-stripline device as claimed in claim 1, wherein the second edge of at least one of the first and second conductive traces includes a plurality of outwardly extending protrusions distributed along a length of the second edge.

6. The suspended-stripline device as claimed in claim 5, wherein the plurality of outwardly extending protrusions are evenly distributed along the length of the second edge.

7. The suspended-stripline device as claimed in claim 1, wherein a size and orientation of the at least one outwardly extending protrusion is selected so as to compensate for unequal even and odd mode propagation velocities through the suspended-stripline device.

8. The suspended-stripline device as claimed in claim 1, wherein insertion loss of the suspended stripline device is less than approximately 0.2 dB.

9. A circuit in a suspended-stripline device, the circuit comprising:

an input for receiving an input signal;

an output for providing an output signal;

a transmission line section located between the input and the output; and a lumped capacitance located at approximately one end of the transmission line section and connected between the end of the transmission line section and a reference potential, the lumped capacitance serving to compensate for differences in even and odd mode propagation velocities along the transmission line sections, wherein an insertion loss between the input and output is less than approximately 0.2 dB.

10. The suspended-stripline device as claimed in claim 9, wherein the transmission line section is approximately one quarter-wavelength long corresponding to a center operating frequency of the suspended-stripline device.

11. A suspended-stripline device comprising:

first and second conductive traces disposed on a dielectric substrate;

a housing at least partially surrounding the dielectric substrate;

an input coupled to the first conductive trace; and an output, coupled to at least one of the first and second conductive traces;

wherein an insertion loss between the input and the output is less than a proximately 0.2 dB.

12. The suspended-stripline device as claimed 11, wherein a dielectric constant of the dielectric substrate is in a range of approximately 2.1 to 10.5.

13. The suspended-stripline device as claimed in claim 11, wherein a dielectric constant of the dielectric substrate is in a range of approximately 2.17–3.48.

14. The suspended-stripline device as claimed in claim 11, wherein each of the first and second conductive traces has a first edge and a second edge and the second edge includes at least one outwardly extending protrusion.

15. The suspended-strip device as claimed in claim 14, wherein a size and orientation of the at least one outwardly extending protrusion is selected so as to compensate for unequal even and odd mode propagation velocities through the suspended-stripline device.

16. The suspended-stripline device as claimed in claim 15, wherein the first and second conductive traces each include a section having a predetermined length; and wherein at least one outwardly extending protrusion is located proximate an end of the section.

17. The suspended-stripline device as claimed in claim 16, wherein the predetermined length of the section of the conductive traces is approximately one quarter-wavelength corresponding to a center operating frequency of the suspended-stripline device.

18. A suspended-stripline device comprising:

a circuit disposed on a dielectric substrate, the circuit having an input for receiving an input signal, an output for providing an output signal, and at least one metal contact;

a metal housing at least partially surrounding the circuit, the housing including a plurality of tabs, the tabs being folded about the dielectric substrate so as to contact the at least one metal contact and electrically connected to the at least one metal contact, a height of the housing selected so as to provide a predetermined volume of space between the dielectric substrate and a top portion of the housing.

19. The suspended-stripline device as claimed in claim 18, wherein the housing includes a flange portion that determines the height of the housing.

20. A method of manufacturing a suspended-stripline device, the method comprising acts of:

disposing a circuit on a dielectric substrate;

coating a selected piece of metal with solder;

forming a housing section out of the metal, the housing section having predetermined shape including a plurality of tabs along an edge of the housing section;

folding the plurality of tabs about an edge of the dielectric substrate; and heating the housing section to a temperature sufficient to melt the solder, thereby causing the plurality of tabs to bond to a conductive trace on the dielectric substrate and securing the substrate to the housing.

21. A method of manufacturing a suspended-stripline device including a circuit disposed on a dielectric substrate, the method comprising acts of:

forming a metal housing section having a predetermined shape including a plurality of tabs along an edge of the housing section;

providing solder on at least one of the substrate and the plurality of tabs;

folding the plurality of tabs about an edge of the dielectric substrate; and heating the housing section to a temperature sufficient to melt the solder, thereby causing the plurality of tabs to bond to the substrate, securing the substrate to the housing.

22. The method as claimed in claim 21, wherein the act of forming metal housing section includes forming the housing section out of a piece of sheet metal.

23. The method as claimed in claim 22, wherein the act of providing solder includes coating at least a portion of the piece of sheet metal with a layer of solder.

* * * * *

UNITED STATES PATENT AND TRADEMARK OFFICE

CERTIFICATE OF CORRECTION

PATENT NO. : 6,822,532 B2
DATED : November 23, 2004
INVENTOR(S) : John R. Kane et al.

It is certified that error appears in the above-identified patent and that said Letters Patent is hereby corrected as shown below:

Column 12,
Line 26, should read -- conductive traces, wherein the second edge of each of --
Line 58, should read -- wherein an insertion loss of the suspended stripline device is --

Column 13,
Line 4, should read -- velocities along the transmission line section, --
Line 20, should read -- is less than approximately 0.2 dB. --
Line 30, should read -- 15. The suspended-stripline device as claimed in claim 14, --

Column 14,
Line 18, should read -- section having a predetermined shape including a plural- --
Line 43, should read -- forming a metal housing section includes forming the housing --

Signed and Sealed this

First Day of February, 2005

JON W. DUDAS
*Director of the United States Patent and Trademark Office*